United States Patent [19]

Pattermann

[11] 4,253,593

[45] Mar. 3, 1981

[54] FLAT TROWEL CARRIERS AND COMBINATIONS THEREWITH

[76] Inventor: Norbert C. Pattermann, 320 E. Alpine St., Altamonte Springs, Fla. 32701

[21] Appl. No.: 130,861

[22] Filed: Mar. 17, 1980

[51] Int. Cl.[3] ..... A45C 11/00

[52] U.S. Cl. ..... 224/253; 224/904; 224/232

[58] Field of Search ..... 224/253, 191, 224, 226, 224/232, 234, 250, 904

[56] References Cited

U.S. PATENT DOCUMENTS

| | | | |
|---|---|---|---|
| 312,085 | 2/1885 | Claghorn | 224/904 X |
| 1,504,927 | 8/1924 | Baust | 224/232 X |
| 2,903,171 | 9/1959 | Rutledge, Jr. | 224/232 |
| 3,172,583 | 3/1965 | Smith | 224/234 |
| 3,343,735 | 9/1967 | Breeding et al. | 224/904 X |

*Primary Examiner*—Steven M. Pollard
*Attorney, Agent, or Firm*—Roger L. Martin

[57] ABSTRACT

A flat trowel carrier has a main pocket for the flat trowel and an auxiliary pocket for another trowel. The main pocket is formed by a pair of pliable components. One component forms the back wall of the pocket and the other component has a pair of narrow marginal portions that straddle the opposite side edges of the back wall forming component and are fixed thereto at its back face. The front wall has a vertically extending wall strengthening and rib forming medial portion and at the top of the front wall, the pocket has a V-shaped opening which terminates at its lower end at the upper end of the rib forming medial portion.

4 Claims, 5 Drawing Figures

FLAT TROWEL CARRIERS AND COMBINATIONS THEREWITH

BACKGROUND OF THE INVENTION

The invention relates to flat trowel carriers and to trowel combinations therewith.

So-called "flat trowels" are well known in the art and include the cement finisher's trowel, the plasterer's trowel, the drywall taper's trowel and the tile setter's trowel among others. These flat trowels are characterized as having a generally rectangular metal blade or working component and an elongated handle that is offset from the rear face of the blade and thereat fixed apart from the blade by means of a bracket that is fixed to the blade and provided with a single neck piece through which one end of the handle is attached to the blade. This handle mounting arrangement permits the worker to grasp the handle by a simple movement in which the thumb passes over and the remaining fingers pass beneath the heel end of the handle in assuming the handle grasping position on the tool.

The need frequently arises for a worker to set aside the flat trowel so as to have both hands free for some other task, or to be able to use some other trowel in the task at hand and for which the flat trowel is less suited for use. A body carrier is a desirable place to temporarily store the tool so that it will be readily available when next needed. However, the flat trowels are bulky instruments and one of the problems which is involved in providing a suitable carrier or receptacle for receiving the flat trowel is the fact that the flat trowel has a broad blade width which renders it difficult to insert the blade in an opening which is defined by flexible materials. The applicant has designed a flat trowel carrier which is admirably suited for use during most assigned tasks that involve the use of a flat trowel. The opening through which the trowel is received on the carrier is defined in that instance by a metal retaining element. However, as it is suspended in the carrier, there is such little resistance to withdrawal of the trowel from the carrier that the trowel may be dislodged from the carrier fairly easily by any upwardly directed sharp blow on an exposed part of the trowel. The inadvertent dislodging of the flat trowel from the carrier at ground level creates no real safety problem. However, if this happens while the worker is on scaffolding, those working on the ground in the vicinity of the scaffolding are placed in jeopardy of being injured if the flat trowel falls from the worker's high level support. As such, there is need for a flat trowel carrier which is structured to make it difficult for the trowel to be accidentally removed. Apart from the need for a carrier which may be safely used at the elevated work areas, the need exists for a suitable carrier for the flat trowel and which is also adapted to carry one or more of the other trowels that are frequently needed for completing an assigned task. Typical of such other trowels are the pointing, duckbill and margin trowels that have a pointed or narrow toed blade. These trowels are much smaller than the flat trowels and are characterized among other things by a handle which is offset rearwardly from the heel of the pointed or narrow toed blade involved in the structure of the auxiliary instrument.

SUMMARY OF THE INVENTION

Flat trowels are bulky instruments to house or support on a trowel carrier that is designed for suspension from a worker and, among other things, they should be designed to protect the worker from the sharp corners of the blade as the trowel is carried about on the body of the worker. As previously indicated, the structure of the trowel should also be such as to resist inadvertent removal of the trowel from the carrier during the work process. Apart from this, the very nature of the task involved in using the flat trowels is such that plastic materials will be commonly adhering to the blades as the trowel is being inserted in the carrier. As such, the carrier design should be such as to avoid any accumulations of such materials in or around the carrier and whereat they might otherwise build up to a hardened mass that would interfere with the use of the carrier. The carrier should, of course, be reasonably inexpensive to manufacture and should also incorporate a design which readily facilitates the insertion and retrieval of the instruments from the carrier. Apart from the above, when two or more trowels are contemplated for storage on the carrier, the design should contemplate the ready and easy insertion and retrieval of each instrument without interference from the other instrument.

The inventor's carrier is primarily made from flexible or pliant sheet components or members in accord with certain aspects of the invention, tanned leather members or members made from other suitably pliable sheet materials being preferred. The pliable materials have a tendency to flex and provide greater resistance to the movement of a trowel than do metal or other rigid materials as when a trowel is inadvertently subjected to a sharp force or blow. The use of such pliant materials in a flat trowel carrier structure, however, has a tendency to make it difficult for the worker to insert the trowel in the carrier structure because the trowel blade corners have a tendency to dig into the pliant material as the worker tries to insert it as for example into the pocket opening of a carrier made from such pliant materials. To overcome this problem, the inventor's flat trowel carrier has a pocket for receiving and housing the blade of the flat trowel and wherein the front wall forming component of the pocket is so-attached to the back wall forming component that a pair of rolls are formed at each of the leading and trailing side edges of the pocket. These rolls tend at the opening for receiving the blade in the pocket to keep the front wall in a position at which it is generally spaced apart from the face of the back wall forming member and throughout the entire width of the narrow pocket opening. This is accomplished by securing or attaching the opposite side edge marginal portions of the front wall forming component along the opposite side edges and at the rear face of the back wall forming component. As such, the marginal portions overlay the back or rear face of the back wall forming component and the front face of the back wall forming component is unobstructed by structure that would interfere with the insertion of the blade through the pocket opening. In accord with other aspects of the invention, the front wall forming component is stiffened between its opposite side edge marginal portions by a medial portion that is formed in the manner such as to provide a vertically extending wall stiffening rib which projects outwardly of the pocket area. This rib, among other things, tends to prevent the center portion of the front wall in the area of the upper pocket opening from collapsing inwardly into the opening and whereat it would otherwise interfere with the insertion of the trowel blade in the pocket. The upper or top end portion of the pocket front wall has a pair of edges which converge downwardly toward the upper end of the rib forming medial portion and in an arrangement such that the neck of the trowel comes to a resting place in the apex area formed by the generally V-shaped converging edge arrangement and at the upper end of the rib forming medial portion. In accord with other aspects of the invention, the bottom or lower end of the pocket is also provided with an opening that spans the width of the back wall forming component so as to permit the ready discharge of any cementitious materials that enter the interior of the pocket and avoid points at which such materials can collect and harden.

In accord with certain aspects of the invention, the front wall forming component of the flat trowel pocket is made from a pair of pliant members, one of which forms the back wall of the auxiliary pocket. The front wall of the auxiliary pocket is formed by yet another pliant member and which, in this case, has a side marginal portion which in the assembled carrier overlies and is attached to the marginal portion of the auxiliary pocket back wall forming member. The other marginal portion of the auxiliary pocket front wall forming member is attached to the exterior face of the back wall forming member for the auxiliary pocket. Like the main pocket, the auxiliary pocket has upper and lower openings but unlike the main pocket, the need for providing a means to keep the pocket fully opened is lacking since a pointed or narrow toed trowel blade can be inserted in a narrow opening defined by a flexible component much easier than a broad toed blade structure.

A general object of the invention is to provide an improved carrier for a flat trowel. One specific objective is to provide a flat trowel carrier having improved safety features. Yet another objective is to provide a flat trowel carrier which utilizes pliant members in the formation of a receptacle or pocket for the trowel blade and which is designed for easy insertion and retrieval of the trowel blade by the worker. Still another objective is to provide a flat trowel carrier that features the foregoing objectives and which is devoid of structure in the pocket area which would collect hardened cementitious materials. Yet another object is to provide a flat trowel carrier of the kind contemplated above and which is also adapted to house a second trowel. Other objectives will be apparent from the disclosure which follows.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, and wherein:

DESCRIPTION OF PREFERRED EMBODIMENT

Figure 1:
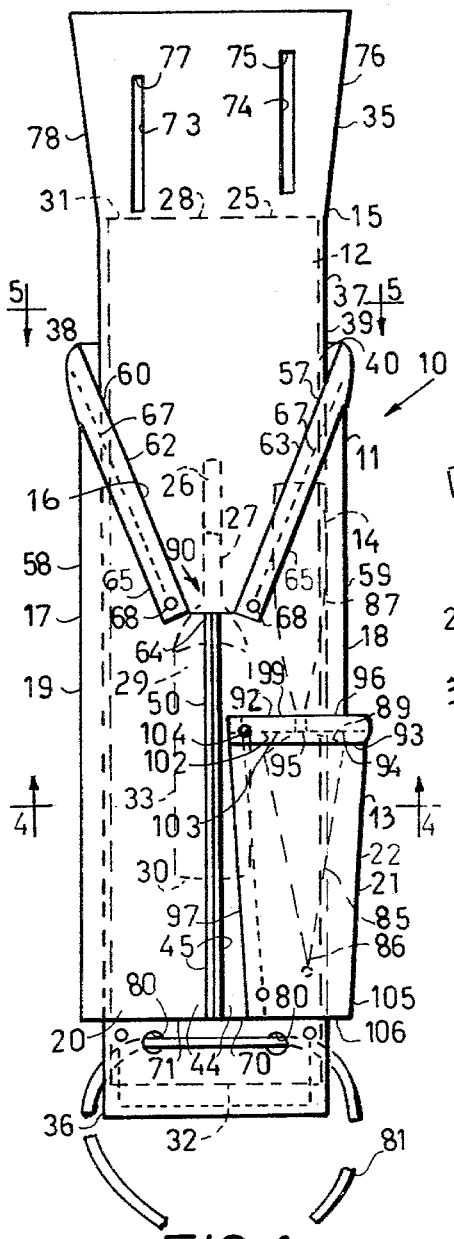
FIG. 1 is a front elevational view of a flat trowel carrier embodying principles of the invention and wherein certain parts are broken away and the trowels that are housed in the carrier are shown in broken lines.
Figure 3:
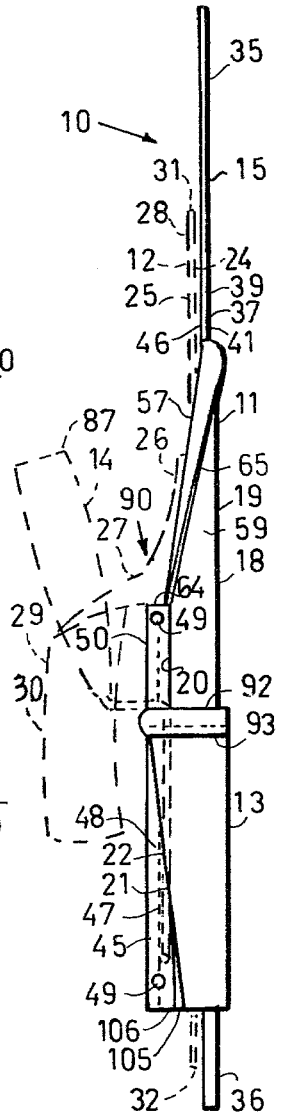
FIG. 3 is a side elevational view of the carrier as seen at the leading side in FIG. 1, with certain parts being removed and the trowels again being shown in broken lines.
Figure 2:
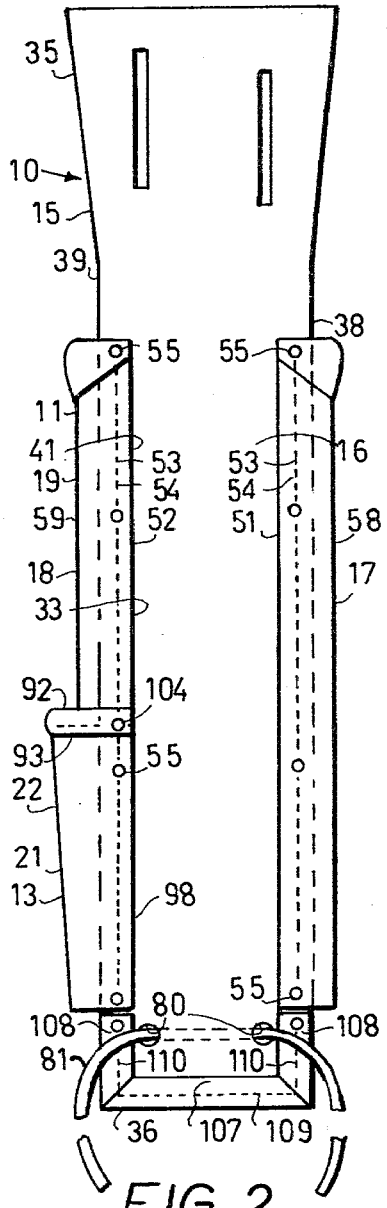
FIG. 2 is a rear elevational view of the carrier as seen in FIG. 1 with certain parts broken away.
Figure 4:
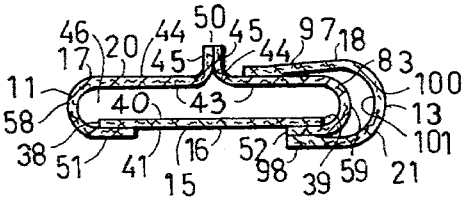
FIG. 4 is a horizontal sectional view as taken transversely through the carrier and generally along the lines 4—4 of FIG. 1.
Figure 5:
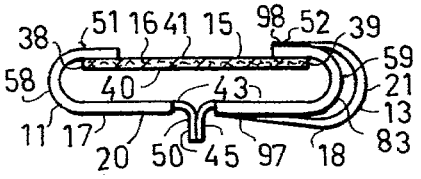
FIG. 5 is a horizontal sectional view taken transversely of the carrier and generally along the lines 5—5 of FIG. 1.

Reference is now made to the drawings and wherein a trowel carrier 10 embodying the principles of the invention is seen as having a main pocket 11 for a flat trowel 12 that is shown in broken lines in the drawings. The carrier 10 also has an auxiliary pocket 13 for housing another trowel 14 which is also shown in broken lines and which may be pointing, duckbill or margin trowel that is much less frequently used by a worker than the flat trowel 12 which is seen as housed in main pocket 11.

The carrier 10 includes an elongated, pliant and generally rectangular flat body member or component 15 that serves, among other things, to form the back wall 16 of the main pocket 11. It also includes a pair of flat pliant members 17 and 18 which provide a pliant carrier component 19 that forms the front wall 20 of the main pocket 11 for the flat trowel 12. Yet another flat, pliant member or component 21 forms the front wall 22 of the auxiliary pocket 13 for the carrier. These flat, pliant members 15, 17, 18 and 21 are preferably made from tanned leather or other suitably pliant sheet materials.

The flat trowel 12 comprises an elongated, generally flat, rectangular blade 28 which has opposite faces that include the front or working face 24 of the trowel and a back face 25. The trowel 12 also has a bracket 26 which is fixed to the back face 25 of the blade and provided with a neck portion 27 that extends between the blade 28 and the toe end 31 of an elongated handle 33 so as to rigidly secure the handle in a position that is spaced apart and offset from the back face 25 of the blade. As will be subsequently seen, the neck portion 27 of the bracket rests on an upper edge portion of the front wall 20 structure of pocket 11 and in a manner such that the heel end 30 of the handle is in front of the wall 20 when the blade is housed in the pocket 11.

The flat body member 15 is elongated and generally rectangular in shape and has an upper end portion 35 as well as a lower end portion 36. These portions 35 and 36 are vertically spaced apart by an intermediate portion 37 which is located therebetween and serves to form the back wall 16 of the flat trowel pocket 11. The intermediate portion 37 of the member 15 is integrally joined to the end portions 36 and 35 and it has a pair of opposite side edges 38 and 39 and a pair of opposite faces 40 and 41 which extend between these opposite side edge extremities 38 and 39 of the intermediate portion. The front face 40 of portion 37 confronts the interior 46 of pocket 11 while the rear face 41 normally confronts the worker's leg when the carrier is suspended from the worker's body during use.

The component 19 that forms the front wall 20 of the main pocket 11 is made from a pair of flat, pliant members 17 and 18. Each one of these leather members 17 and 18 has a pair of opposite side faces that include an interior face 43 and an exterior face 44. Each of these members 17 and 18 also has a narrow, elongated side edge border or marginal portion 45 that is secured in face-to-face relation along its interior face 43 to the side edge border portion 45 of the other member of the component 19. The interior faces 43 of members 17 and 18 generally confront the interior 46 of the flat trowel pocket 11 and the marginal portions 45 are secured together as by means of stitches 47 along line 48 and a pair of rivets 49 at the opposite ends of the stitch line 48. This arrangement provides a rib forming medial portion 50 in the front wall forming component 19 and which stiffens the wall formed by the pliant material to aid in maintaining the top and bottom openings in the pocket 11.

The component 19 formed by the assembled members 17 and 18 has a pair of narrow, opposite side edge marginal portions 51 and 52. These marginal portions 51 and 52 in the assembled carrier are arranged to overlay the rear face 41 of the intermediate body portion 37 and along the respective opposite side edge extremities 38 and 39 thereof. Here, the front wall forming component 19 for pocket 11 is secured to the intermediate portion 37 by means of stitches 53 along stitch line 54 and by means of spaced apart rivets 55. The stitches 53 and rivets 55 pass through the body member 15 and through the marginal portions 51 and 52 which are located at the rear face 37 of member 15 so that the material of the pliant component 19 which is located at the front face 40 and adjacent to the opposite side edge marginal portions 51 and 52 of the component 19 in the assembled carrier, tends to form rolls 58 and 59 at the trailing and leading side edges of the pocket 11. These rolls serve to keep the pocket open by maintaining a spaced relation along the opposite side edges 38 and 39 between the front face 40 of the intermediate portion 37 and the interior faces 43 of the component members 17 and 18. This facilitates and makes it easier for the worker to insert the trowel blade in the pocket 11 by avoiding collapse of the pocket material at and into the pocket opening 60.

Component 19 also has a narrow, V-shaped, top end portion 57 which is located adjacent to the upper end portion 35 of the body member. In the assembled carrier 10 and between the opposite side edges 38 and 39, this portion 57 of the component is supported and spacedly apart and outwardly offset from the front face 40 of the intermediate body portion 37 by means of the opposite side rolls 58 and 59 that are provided in the pocket structure for reasons of the arrangement utilized in securing the front wall forming component 19 to the back wall forming component 15. The spaced apart arrangement of the top end portion 57 also provides a narrow top pocket opening 60 at the upper end of the pocket 11 and which extends across the entire front face 40 of the intermediate portion 37 and thus between its opposite side edge extremities 38 and 39. The arrangement used for securing components 19 and 15 together also avoids any obstructions to the insertion of the trowel blade into the pocket through the opening 60 as would happen if the marginal portions of the component 19 were secured to the body member at the front face thereof.

The V-shaped, top end portion 57 of component 19 has a pair of upper edges 62 and 63 that converge inwardly from the opposite side rolls 58 and 59 in a downward direction toward the upper end 64 of the rib forming medial portion 50. Here, each of the pliant members 17 and 18 is provided with an upper end flap 65 that is folded over and secured along the respective edges 62 and 63 by means of stitches 66 along lines 67. Adjacent to the upper end 64 of the rib 50, each flap 65 is secured to the pliant member by a rivet 68. The flap and rib arrangement serves to strengthen the pliant component 19 along the top pocket opening 60 and thus aids in maintaining the offset arrangement of the component 19 and body member face 40 at opening 60.

In addition to the top end portion 57, component 19 also has a bottom end portion 70. Portion 70 is located adjacent to the lower end portion 36 of the body member 15. Here, in the assembled pocket 11 and between the opposite side edge extremities 38 and 39 of the intermediate body portion 37, the bottom end portion 70 is also supported spacedly apart and outwardly offset from the front face 40 of intermediate portion 37 by the opposite side rolls 58 and 59. This provides a bottom opening 71 between the interior and exterior of the pocket and which also extends across the entire face 40 of the intermediate portion 37 and thus also between the opposite side edge extremities 38 and 39 so as to make it easier for any cementitious materials that get into the pocket to fall out.

At this point, it should be noted that the narrow medial portion 50 of the pliant component 19 formed by members 17 and 18 is vertically oriented in the assembled carrier 10 and projects outwardly of the pocket midway between or intermediate the opposite side edge marginal portions 51 and 52 of the pliant component 19 so as to again avoid any structure at the interior of the pocket and which interferes with the insertion of the trowel blade. It should furthermore be noted that the rib forming medial portion 50 extends throughout the distance between the top and bottom pocket openings 16 and 71 so as to stiffen the center area of the front wall 20 and thus aid in keeping the pocket opened at its opposite ends.

Among the ways in which the worker may place the flat trowel 12 in the pocket 11, the worker may grasp the handle 33 of the trowel 12 so that the toe portion 32 of the trowel 12 is in front of the worker's thumb while the working face 24 confronts the worker's body. As thus held, the worker may bend and simultaneously swing his arm backwardly at his side and to the extent necessary to catch the lower side edge of the blade at the lowermost corner of the blade heel portion 32 at the upper end of the leading side roll 59 and between the back wall 16 and front wall 22 of the pocket 11. As thus caught at the top opening 60, it is a simple maneuver for the worker to then rotate the toe portion 31 of the trowel blade upwardly and rearwardly about the upper end of the leading roll 59 and to the point that the other corner of the blade heel 32 enters the top opening 60 between the front and back walls 22 and 16 at the top of the trailing side roll 58. When this happens, the blade 28 simply falls by gravity into the pocket 11. As the trowel falls, the neck portion 27 of the bracket 26 is guided into the apex area 90 at the opening 60 and into resting contact with the top end portion 57 of component 19 and the upper end 64 of the rib forming medial portion. As thus suspended in the pocket 11, the handle 33 of the trowel is at the exterior of the front wall 22 and the toe 31 of the blade is above the top opening 60 and in an arrangement such that the working face 64 of blade 28 confronts the front face 40 of the intermediate body portion 37.

Above the toe end 31 of trowel 12, the upper end portion 35 of the body member 15 is provided with a pair of laterally spaced apart and vertically extending slots 73 and 74 and which are used for receiving a body belt to suspend the trowel carrier from the users body. The upper extremity 75 of slot 74 at the leading edge 76 of carrier 10 is offset further from the top opening 60 than is the upper extremity 77 of slot 73 at the trailing edge 78. This gives the carrier a forward cant when it is suspended from a body belt and provides easier access to the pocket opening 60 as the carrier hangs at the worker's side.

The lower end portion 37 of body member 15 has a pair of holes 80 for receiving a rawhide length 81 that may be used for securing the lower end of the carrier to the leg of the user.

Other material may obviously also be used for providing this means for securing the lower end of the carrier to the users leg. Here at the end portion, the carrier is also provided with an end flap 107 and a pair of opposite side flaps 108. These flaps 107 and 108 are folded backwardly and stitched at the lower end portion 37 as along the bottom stitch line 109 and the stitch lines 110 at the opposite sides of the carrier.

The back wall 83 of the auxiliary pocket 11 for housing the trowel 14 is formed by the pliant member 18 while the front wall 22 is formed by the pliant member 21. The structure of this auxiliary pocket 13 is such as to receive a trowel which is provided with a blade 85 that has a pointed or narrow toe 86 and with a handle 87 that is rearwardly offset from the heel 88 of the blade.

Pliant member 21 has an elongated, narrow upper end portion 92 which is formed by forming an upper end flap 93 outwardly over the exterior face 100 of member 21 and by thereat securing it to the member 21 as by stitches 94 along stitch line 95. This stiffens the upper end portion of the pliant member 21 so that the center portion 96 of the end portion 92 tends to remain spacedly apart from the exterior face 44 of member 18 in the assembled carrier. This facilitates the provision of an accessible entranceway in the upper pocket opening 99 for receiving the toe 86 of the blade 84 of trowel 14. Member 21 also has opposite side edge border portions 97 and 98. In the assembled pocket 13, the interior face 101 of member 21 facially confronts the exterior face 45 of member 18 and the side edge border portion 98 is arranged to overlay the marginal portion 52 of component 19 and whereat it is secured to the body member 15 by the stitches 53 at the lower end of line 54 and by the adjacent rivets along the line. The other body portion 97 of the pliant member 21 overlays the exterior of face 44 of member 18 adjacent to the rib forming medial portion 50. Here the border portion 97 of member 21 is secured to the underlying member 18 by stitches 102 along stitch line 103 and by means of a pair of rivets 104. At the bottom end 105 of pocket 13, the pocket is also provided with an opening 106 and through which cementitious material that inadvertently finds its way into the pocket can fall free of the pocket area.

While only a certain preferred embodiment of this invention has been shown and described by way of illustration, many modifications will occure to those skilled in the art and it is, therefore, desired that it be understood that it is intended herein to cover all such modifications that fall within the true spirit and scope of this invention.

What is claimed as new and what it is desired to secure by Letters Patent of the United States is:

1. A flat trowel carrier having a trowel pocket and comprising a pliant, flat, generally rectangular body member which includes an upper end portion, a lower end portion, and an intermediate portion that is located between said upper end portion and said lower end portion, said intermediate portion forming the back wall of said trowel pocket and having opposite side edges, a rear face that extends between said opposite side edges, and a front face that extends between said opposite side edges, said trowel pocket having a front wall forming pliant component that has opposite side edge marginal portions which are located at and overlay the rear face of the intermediate portion along the respective opposite side edges thereof, a bottom end portion which is located adjacent to said lower end portion and is outwardly offset from said front face between the opposite side edges of the intermediate portion to provide a bottom pocket opening that extends across the front face and between the opposite side edges of said intermediate portion, a top end portion which is located adjacent to said upper end portion and is outwardly offset from said front face between the opposite side edges of the intermediate portion to provide a top pocket opening that extends across the front face and between the opposite side edges of said intermediate portion, and an elongated narrow and vertically oriented medial portion which projects outwardly of the pocket and is spacedly offset from and located intermediate the opposite side edge marginal portions of the pliant component to form a vertical rib that extends between said bottom pocket opening and said top pocket opening to stiffen the front wall formed by said pliant component, and means along said opposite side edges of the intermediate portion for securing the opposite side edge marginal portions to the rear face of said intermediate portion, said upper end portion of the body member having means for suspending the carrier from a belt.

2. A flat trowel carrier in accord with claim 1 wherein said front wall forming component includes a pair of flat pliant members, each of said flat pliant members having opposite side faces which include an interior face that generally confronts the interior of said pocket, and an elongated side edge border portion which projects outwardly of the pocket front wall in face-to-face relation with the interior face of the elongated side edge border portion of the other of said pair of flat pliant members, the elongated side edge border portions of said flat pliant members being secured together to thereby provide said vertical rib forming medial portion, said medial portion having an upper end at said top pocket opening, and said top end portion having a pair of edges at the top pocket opening and which generally converge downward toward said upper end of said medial portion.

3. A flat trowel carrier in accord with claim 2 wherein said opposite side faces include an exterior face that faces exteriorly of said pocket and the carrier has an auxiliary pocket for receiving another trowel, said auxiliary pocket comprising a flat pliant member which forms the front wall of said auxiliary pocket and overlays the exterior face of one of said pair of flat pliant members, said flat pliant member of the auxiliary member having spaced apart opposite side edge border portions which are secured to said one of said pair of flat pliant members, an upper end portion which extends between said opposite side edge border portions and defines an upper opening to said auxiliary pocket for receiving the other trowel, and a lower end portion which extends between said opposite side edge border portions and defines another opening to said auxiliary pocket.

4. The combination of a flat trowel and a carrier therefor, said trowel comprising a generally rectangular blade having opposite faces, an elongated handle having opposite ends, and means having a neck portion which extends between the blade and handle and rigidly securing said handle spacedly offset from one of said opposite faces, said carrier having a pocket for receiving the trowel blade and which comprises a front wall and a back wall, said carrier comprising an elongated flat pliant body member which has an upper end portion, a lower end portion, and an intermediate portion that is located between said upper end portion and said lower end portion, said intermediate portion serving to form said back wall and having opposite side edges, a rear face that extends between said opposite side edges, and a front face that extends between said opposite side edges, said carrier further comprising a pliant component that serves to form said front wall and has opposite side edge marginal portions which are located at and overlay the rear face of the intermediate portion along the respective opposite side edges thereof, a bottom end portion which is located adjacent to said lower end portion and is outwardly offset from said front face between the opposite side edges of the intermediate portion to provide a bottom pocket opening that extends across the front face and between the opposite side edges of said intermediate portion, a top end portion which is located adjacent to said upper end portion and is outwardly offset from said front face between the opposite side edges of the intermediate portion to provide a top pocket opening that extends across the front face and between the opposite side edges of said intermediate portion, and an elongated narrow and vertically oriented medial portion which projects outwardly of the pocket and is spacedly offset from and located intermediate the opposite side edge marginal portions of the pliant component to form a vertical rib that extends between said bottom pocket opening and said top pocket opening to stiffen the front wall formed by said pliant component, means along said opposite side edges of the intermediate portion for securing the opposite side edge marginal portions to the rear face of said intermediate portion, said medial portion having an upper end, said top end portion having a pair of edges at the top pocket opening and which generally converge downwardly toward the upper end of said vertical rib forming medial portion, said trowel blade having a heel portion that is received in said pocket and a toe portion that is located above said upper end, said trowel being supported by said front wall with its neck portion resting at said upper end and on said top end portion, said upper end portion of the body member having means offset upwardly from said top end portion for suspending the carrier from a belt.

* * * * *